US005103527A

United States Patent [19]

Holland

[11] Patent Number: 5,103,527

[45] Date of Patent: Apr. 14, 1992

[54] SUCTION CLEANING HEAD

[75] Inventor: John A. Holland, Winthrop, Australia

[73] Assignee: Vax Appliances (Australia) Pty Ltd, Riverdale, Australia

[21] Appl. No.: 499,298

[22] PCT Filed: Nov. 17, 1988

[86] PCT No.: PCT/AU88/00446

§ 371 Date: May 18, 1990

§ 102(e) Date: May 18, 1990

[87] PCT Pub. No.: WO89/04626

PCT Pub. Date: Jun. 1, 1989

[30] Foreign Application Priority Data

Nov. 18, 1987 [AU] Australia ..... PI5496
Jan. 22, 1988 [AU] Australia ..... PI6413

[51] Int. Cl.[5] ..... A47L 11/34
[52] U.S. Cl. ..... 15/322; 15/321
[58] Field of Search ..... 15/321, 322

[56] References Cited

U.S. PATENT DOCUMENTS 3,747,155 7/1973 Koellisch ..... 15/322
4,185,354 1/1980 Brazier ..... 15/321
4,270,238 6/1981 Shallenberg ..... 15/321

FOREIGN PATENT DOCUMENTS 3633111 3/1988 Fed. Rep. of Germany .
2604079 3/1988 France .
1121225 7/1968 United Kingdom .
1167239 10/1969 United Kingdom .
1291138 9/1972 United Kingdom .
1601455 10/1981 United Kingdom .
9003142 4/1990 World Int. Prop. O. ..... 15/322

*Primary Examiner*—Chris K. Moore
*Attorney, Agent, or Firm*—Spencer, Frank & Schneider

[57] ABSTRACT

A suction cleaning head, including a body defining a suction chamber having a boundary wall defining an open mouth and having an outlet adapted to be connected to an air extraction means, and an inner compartment extending across the suction chamber and having a substantially planar open mouth substantially in the plane of the open mouth of the suction chamber, wherein the inner compartment is divided by a separating wall into an outer liquid delivery chamber adjacent to the open mouth of the inner compartment and an internal liquid reception chamber which extends across the suction chamber and which has an inlet adapted to be connected to a supply of cleaning liquid, and a plurality of liquid flow passageways extending through the separating wall between the liquid reception chamber and the liquid delivery chamber, and wherein an airflow passageway extends from the interior of the liquid reception chamber to a position within a low pressure zone downstream of the open mouth of the suction chamber.

11 Claims, 4 Drawing Sheets

14
28
28a
11
27
25
29
30
26
13
23
33
24
21
20

SUCTION CLEANING HEAD

CROSS-REFERENCE TO RELATED APPLICATION

The subject matter of the present Application is closely related to that of Applicant's copending application Ser. No. 07/499,297, filed May 17, 1990.

BACKGROUND OF THE INVENTION

1. Field of the Invention

This invention relates to suction cleaning heads of the kind having a suction chamber which has an internal liquid distributor for connection to a source of cleaning liquid and which is adapted to deliver the cleaning liquid to a surface to be cleaned. Examples of cleaning heads of this kind are disclosed in British patent specifications 1291138, 1121225 and 1601455.

2. BACKGROUND OF THE RELATED ART

The cleaning head disclosed in specifications 1291138 and 1121225 has an internal liquid distributor in the form of a cross-tube which is provided with a plurality of downwardly depending fingers which incorporate fluid passageways for delivering cleaning liquid to the surface to be cleaned. The liquid is caused to flow into the internal cross-tube from the source of cleaning liquid and from the downwardly depending fingers as a result of the influence of low pressure created at the mouth of the suction chamber when the mouth is in engagement with the surface to be cleaned.

When the mouth is out of engagement with the surface, the required low pressure conditions do not exist in the vicinity of the outlets of the fluid passageways and therefore liquid should not be drawn from the fingers in the absence of such low pressure. Accordingly, delivery of cleaning liquid to the surface when the cleaning head is initially applied thereto will be delayed until the liquid has been drawn from the source to the suction head.

However, in circumstances where the suction head is located lower than the source, once the liquid has been delivered to the suction head fluid flow will be maintained as a result of syphonic action even when the suction head is not applied to a surface, and this can result in an uncontrolled flow of cleaning liquid from the head. This uncontrolled flow needs to be controlled by utilisation of a separate valve which will close off the delivery line whereby the cleaning liquid is supplied to the suction head, when the latter is not in contact with the surface. Therefore, while the flow of cleaning liquid to the cleaning head is initiated as a result of the influence of low pressure generated at the cleaning head when applied to the surface to be cleaned, the continuance of such flow is not so controlled.

An additional difficulty which is caused by the cleaning heads as disclosed in specifications 1291138 and 1121225 resides in the fact that the liquid is injected into the carpet by utilisation of a plurality of downwardly depending fingers which can project below the plane of the open mouth of the suction head and will engage the carpet fibres where the surface to be cleaned comprises a carpet. As a result, the suction head can become very difficult to move across the carpet and such movement can cause damage to the carpet fibres, particularly in the case of loop pile carpets.

A further difficulty with suction device resides in the limitation of the width of the cleaning which can be used in accordance with that design. The flow of liquid to the cleaning head is the result of low pressure which is induced in the suction head when applied to floor surface, and due to the limited nature of such flow, the width of the cleaning head is determined by the rate of which the cleaning liquid can be delivered thereto. If the cleaning head is of too great a width, the cleaning liquid drawn to the suction head will be applied through the central fingers only.

A still further difficulty with these cleaning heads is that the cleaning liquid is drawn away immediately on discharge from the apertures in the fingers before the cleaning liquid has time to thoroughly penetrate the carpet fibres and dissolve any soil or dirt therein. Such rapid removal results in inadequate cleaning and the use of excessive volumes of cleaning liquid.

The cleaning head disclosed in British specification 1601455 has an inner compartment containing a small transverse duct through which cleaning liquid is delivered by the influence of some external means such as gravity or a pressurised supply to fine outlets at a position spaced inwardly from the mouth of the cleaning head and shielded from the air flow within the suction head by the side walls of the inner compartment. Whilst this obviates many of the above mentioned difficulties, the cleaning liquid is still delivered to the cleaning head by a means which is independent of the function of the cleaning head and which requires an overriding control through a shut-off valve or the like. As a result, in the event that the cleaning head is inadvertently left with the shut-off valve open after a period of use, the cleaning liquid may continue to be delivered to the cleaning head by syphoning action.

SUMMARY OF THE INVENTION

The present invention resides in an improved suction cleaning head comprising a body defining a suction chamber having a boundary wall defining an open mouth and having an outlet adapted to be connected to an air extraction means, and an inner compartment extending across the suction chamber and having a substantially planar open mouth parallel or co-planar with the open mouth of the suction chamber, wherein said inner compartment is formed or provided with a separating wall dividing it into an outer liquid delivery chamber adjacent to said open mouth of the inner compartment and an internal liquid reception chamber which extends across the suction chamber and which has an inlet adapted to be connected to a supply of cleaning liquid, and a plurality of liquid flow passageways are provided which extend through said separating wall between the liquid reception chamber and the liquid delivery chamber, and wherein a calibrated air-flow passageway extends from the liquid reception chamber to a position within a low pressure zone downstream of the open mouth of the suction chamber, i.e., within the suction chamber, or the outlet thereof, or a suction hose connected thereto.

The air-flow passageway may comprise a plurality of openings located in an upper region of the liquid reception chamber.

Valving means may be provided in the liquid reception chamber to restrict further flow of cleaning liquid into and/or out of the liquid reception chamber when it is full of cleaning liquid. Said valving means may comprise a float bar which is vertically movable within said liquid reception chamber.

Preferably said liquid reception chamber is so dimensioned to serve as a storage reservoir within the cleaning head for the cleaning liquid, which reservoir has a height sufficient to create a substantially equal hydrostatic head pressure at each of the liquid flow passageways. Typically the height of the reservoir may be at least 10 mm.

Preferably said liquid reception chamber has sufficient volume such that when full a substantially equal flow rate of cleaning liquid from each of the liquid flow passageways can be achieved during application of the open mouth to a surface. Typically, the volume may be approximately 1 cc per linear centimeter of the head.

The edges of the inner compartment at the open mouth thereof may be formed with a plurality of grooves.

According to a further preferred feature of the invention said inner compartment may be formed as a separate unit which is removable from the suction chamber, although it may alternatively be formed integrally.

A plurality of such inner compartments may be provided in end-to-end relationship across the head.

BRIEF DESCRIPTION OF THE DRAWING

The invention will now be described by way of example with reference to the specific embodiments as illustrated in the accompanying drawings wherein.

DESCRIPTION OF THE PREFERRED EMBODIMENT

Figure 1:
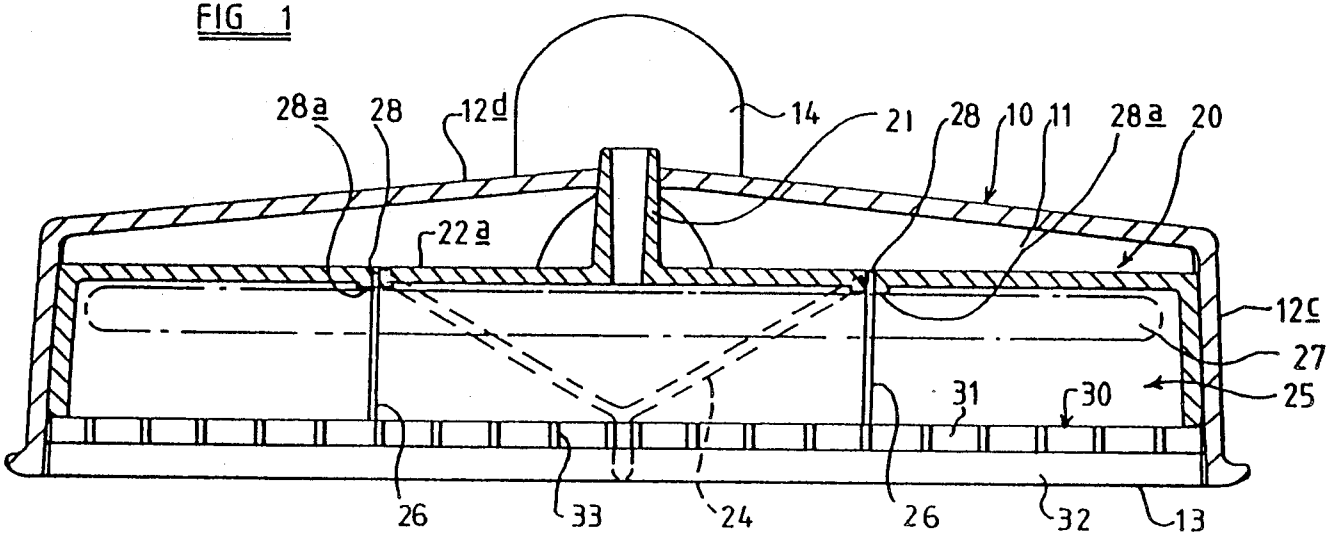
FIG. 1 is a sectional front elevation of a first embodiment.
Figure 2:
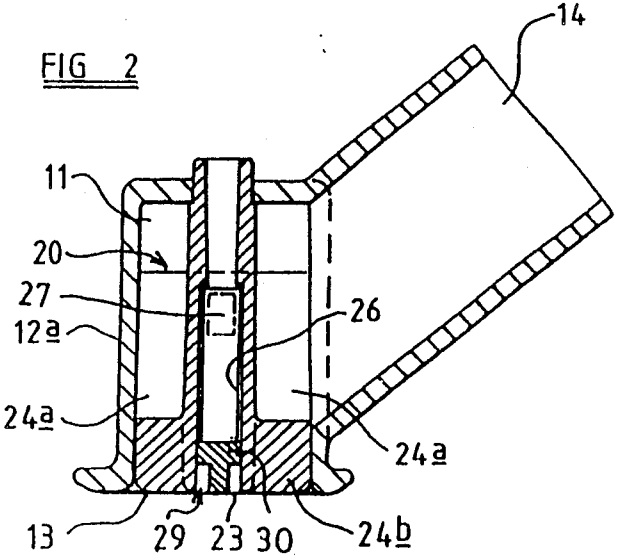
FIG. 2 is a transverse cross-section on the centre line of the first embodiment.

The first embodiment as shown in FIGS. 1 to 8 comprises a cleaning head having an outer housing 10 defining a suction chamber 11 having front and rear side walls 12*a*, 12*b* and end walls 12*c* which define an open planar mouth 13 of substantially rectangular configuration at the underside of the head. The outer housing 10 is formed with an outlet 14 which extends centrally from the suction chamber 11 and is adapted to be connected to an air extraction means by a conventional suction hose (not shown).

The end walls 12*c* of the outer housing 10 support between them a structurally separate inner compartment 20 which extends along the entire length of the suction chamber 11 between the ends thereof and which is spaced inwardly from the front and rear side walls 12*a*, 12*b*. The outer edges of the front and rear walls 22 of the inner compartment 20 are substantially co-planar with the outer edges of the walls of the suction chamber 11 and define an open planar mouth 23.

The inner compartment 20 is formed with a tubular spigot 21 on its upper face which opens to the interior of the inner compartment 20 and forms a liquid inlet therefor. The upper end of the tubular spigot 21 extends through an aperture in the top wall 12*d* of the suction chamber 11 when the inner compartment is located within the suction chamber. The inlet is intended to be connected to a source of cleaning liquid by tubing or like means (not shown) which source may comprise an unpressurised reservoir.

The portion of the inner compartment 20 adjacent to the open mouth 23 accommodates a T-section bar member 30 whereof the transverse web 31 is received innermost and is supported within the inner compartment 20 by abutment against the ends of internal ribs 26 provided on the interior faces of the side walls 22 of the inner compartment 20. The central leg 32 of the T-section bar member 30 extends downwardly from the web 31 and terminates in the plane of the open mouth 23 of the inner compartment 20.

The lateral edges of the transverse web 31 of the T-section bar member 30 are formed with a plurality of spaced grooves 33 which extend between each face thereof.

The transverse web 31 of the T-section bar member 30 forms a separating wall which divides the inner compartment 20 into an internal liquid reception chamber 25 above the transverse web 31 and an outer liquid delivery chamber 29 below the transverse web 31, between which chambers communication is provided through the grooves 33.

The uppermost region of the inner compartment 20 is provided with a calibrated air-flow passageway comprising in the illustrated embodiment a pair of small apertures 28 which extend between the inner and outer faces of upper wall 22*a* of the inner compartment 20 and provide communication between the interior of the liquid reception chamber 25 and the upper region suction chamber 11 in the vicinity of the outlet 14.

The outer faces of the side walls 22 of the inner compartment 20 are additionally formed with baffles 24 which abut at their outer edges against the inner faces of the front and rear side walls 12*a*, 12*b* of the suction chamber 11. The baffles 24 in the illustrated embodiment comprise a pair of vanes 24*a* arranged in shallow V formation centrally of the head and serve to deflect the air-flow entering the suction chamber 11 through the open mouth 13 outwardly towards each end thereof to enhance the equilization of the reduced pressure created across the open mouth 13 of the suction chamber and to evenly direct incoming air-flow into the suction chamber. In the illustrated embodiment the baffles 24 additionally include a vertical vane 24*b* which extends downwardly from the junction of the vanes 24*a* to the lower edge of the inner compartment 20.

If desired, the inner compartment may be formed as a set of modules which can be interengaged in end-to-end relationship and to be receivable within suction heads of a variety of dimensions as required. By the use of such separate modules, a conventional suction head may be adapted for use for wet cleaning of floor surfaces.

Due to the small apertures 28 in the upper wall 22*a* of the inner compartment 20, the internal liquid reception chamber 25 is subjected to reduced pressure when the head is connected through the outlet 14 to air extraction means. As a result of such low pressure within the liquid reception chamber 25, cleaning liquid is drawn through the inlet 21 into the liquid reception chamber 25, preferably to substantially fill that chamber. When the cleaning head is located in an attitude whereby the open mouth 23 of the inner compartment 20 is not closed by a floor surface whilst suction is applied to the outlet 14, the pressure in the outer delivery chamber 29 of the inner compartment 20 is greater than the pressure within the liquid reception chamber 25, which in turn is greater than the pressure in the suction chamber 11 in the region of the outlet 14.

Accordingly, there is a net air-flow into the liquid reception chamber 25 through the grooves 33 in the T-section bar member 30. While there will also be a flow of cleaning liquid into the liquid reception chamber 25 through the inlet 21 unless a shut-off means is provided in the hose connected to the inlet 21, any cleaning liquid thus drawn into the liquid reception chamber 25 will, if the chamber 25 becomes full, be drawn through the apertures 28 into the suction chamber 11 and hence back through the outlet 14.

The net air-flow from the liquid delivery chamber 29 into the liquid reception chamber 25 serves to prevent, or at least limit, flow of cleaning liquid from the liquid reception chamber 25 to the liquid delivery chamber 29 under these conditions.

Figure 3:
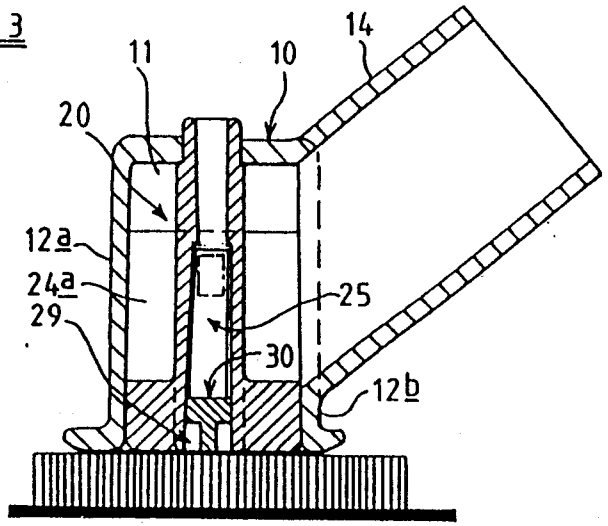
FIG. 3 is a view similar to that of FIG. 2 showing the first embodiment in use.
Figure 5:
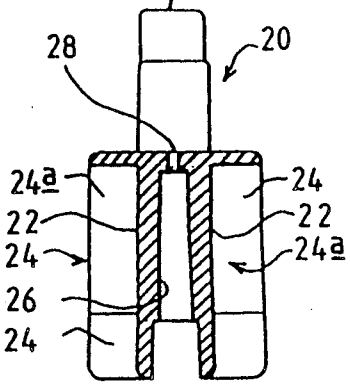
FIGS. 4, 5 and 6 are respectively a side elevation, cross-section and inverted plan view of an inner compartment of the first embodiment.
Figure 8:
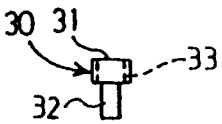
FIGS. 7 and 8 are respectively a side elevation and end elevation of a T-section bar member which is fitted within the inner compartment of the first embodiment.
Figure 4:
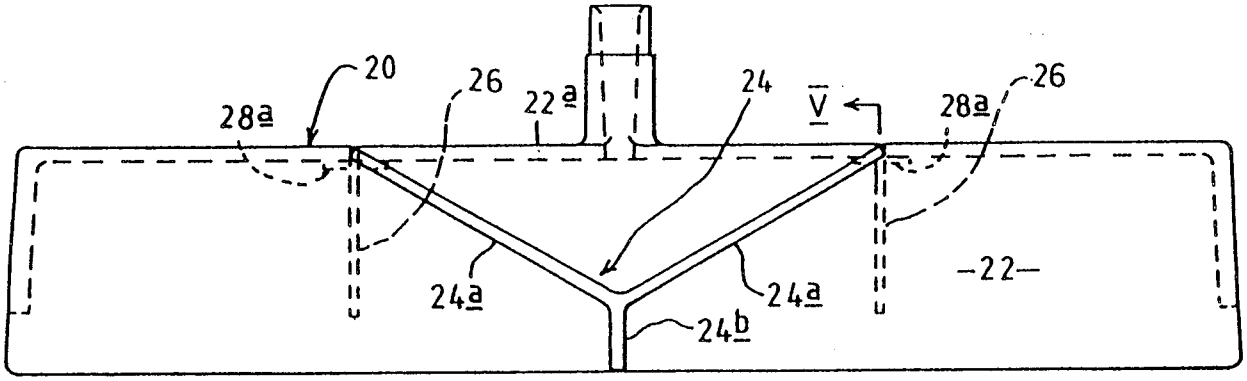
Figure 7:
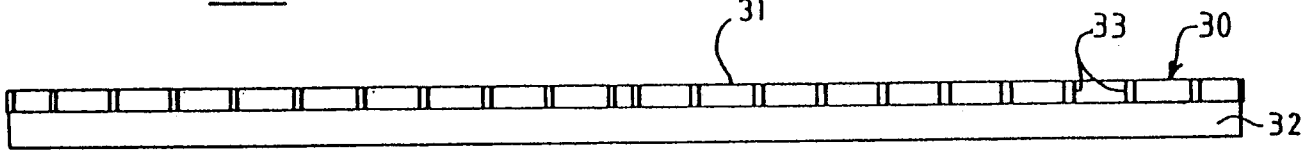
Figure 6:
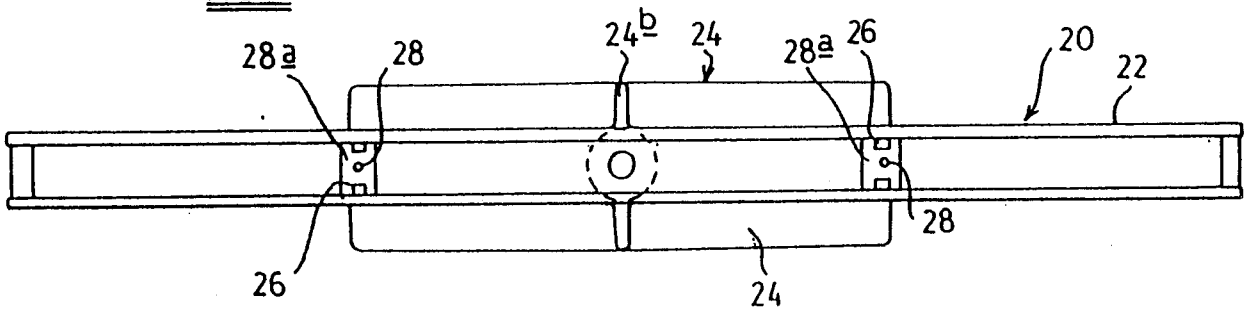
Figures 9, 10, 11:
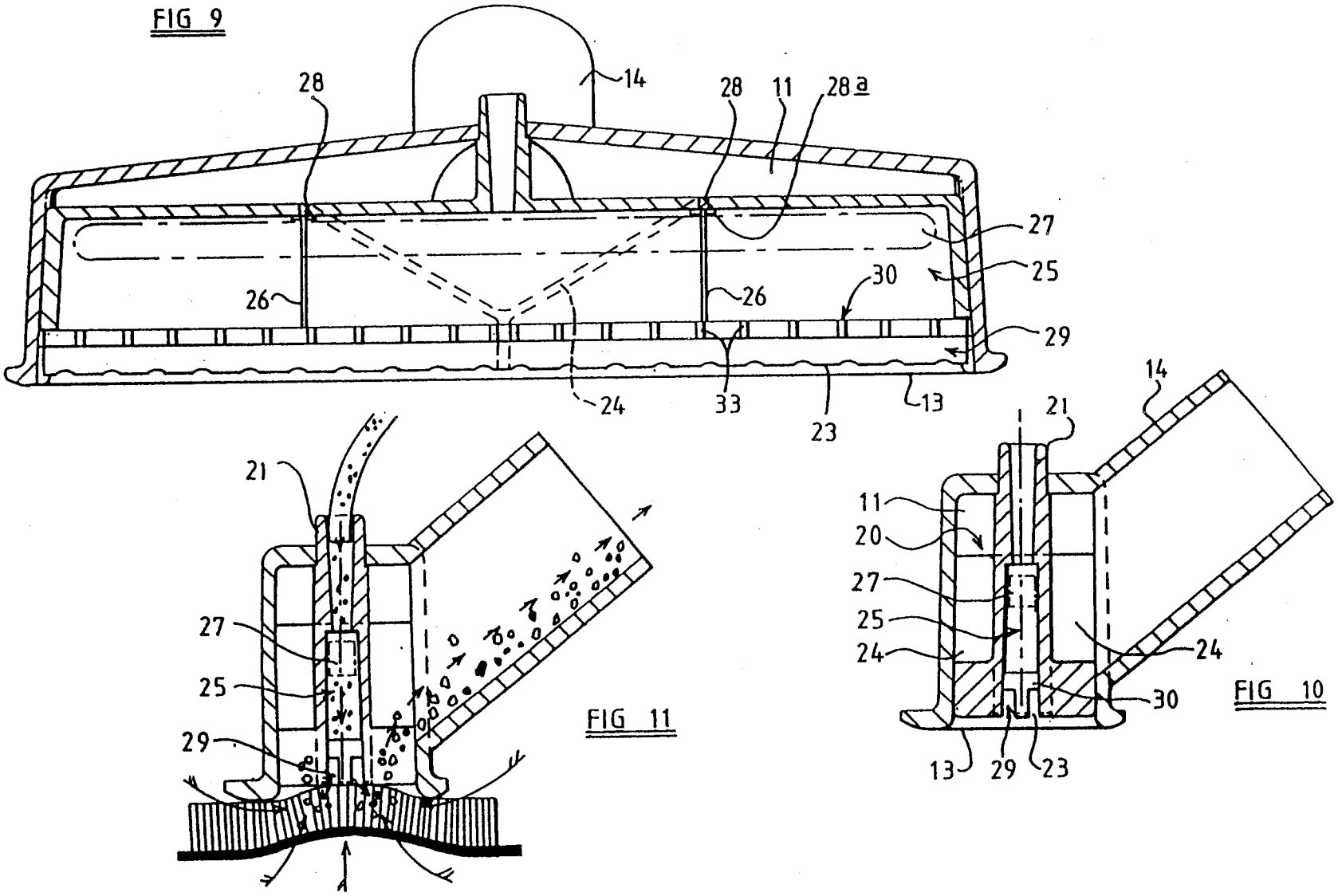
FIG. 9 is a sectional front elevation of a second embodiment.
FIG. 10 is a transverse cross-section on the centre line of the second embodiment.
FIG. 11 is a view similar to that of FIG. 10 showing the second embodiment in use.
Figure 13:
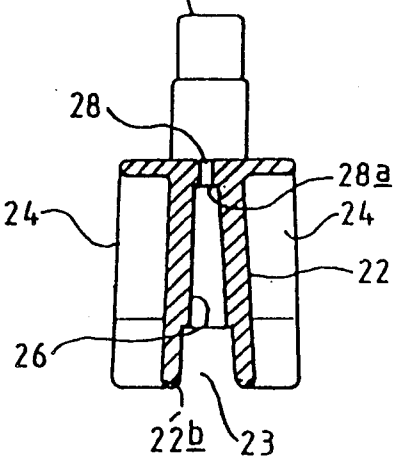
FIGS. 12, 13 and 14 are respectively a side elevation, cross-section and inverted plan view of an inner compartment of the second embodiment.
Figure 12:
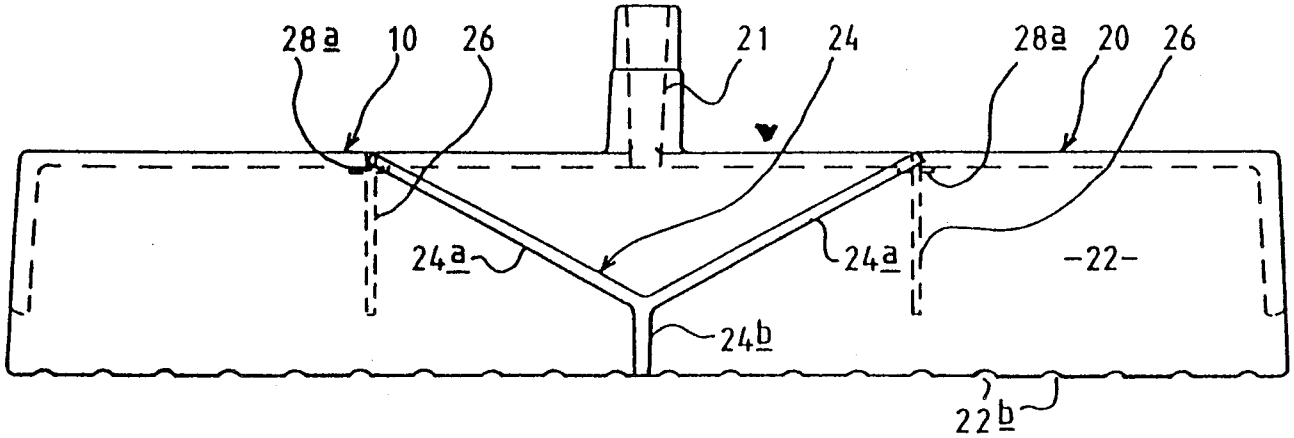
Figure 14:
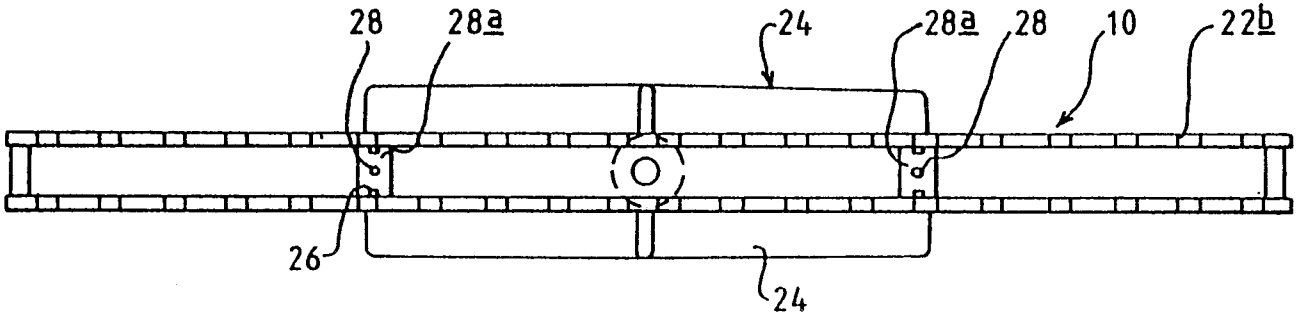

When the open mouth 13 of the suction chamber 11 is placed in engagement with a carpet as shown at FIG. 3, air is drawn into the suction chamber 11 through the carpet fibres. In addition, the pressure in the liquid delivery chamber 29 of the inner compartment 20 is reduced to a value lower than the pressure prevailing in the liquid reception chamber 25, and this assists liquid flow through the grooves 33 into the liquid delivery chamber 29, and thus into the carpet, subsequently to be extracted from the carpet through the suction chamber 11.

Such flow is also assisted by the head of pressure created by the cleaning liquid accumulated in the liquid reception chamber 25, which serves also as a reservoir within the head and ensures that cleaning liquid is delivered from each of the grooves 33 provided substantially over the full length of the T-section bar member 30.

In addition, cleaning liquid will be constantly drawn into the liquid reception chamber 25 as a result of the low pressure induced above the level of cleaning liquid within the liquid reception chamber 25 by virtue of the apertures 28 in the upper wall thereof and preferably to maintain a sufficient depth of liquid to create an hydrostatic head of pressure in the liquid reception chamber so that the cleaning liquid is delivered to the surface to be cleaned under such head of pressure.

In addition, the presence of the side walls 22 of the inner compartment 20 ensures that the cleaning liquid is delivered to the surface to be cleaned rather than being drawn aside into the suction chamber 11 before reaching the surface to be cleaned.

When the head is used on carpet, the cleaning liquid is subsequently drawn through the carpet and towards the suction chamber mouth 13 as a result of the reduced pressure created in the suction chamber. This results in the entire surface beneath the head being thoroughly wetted by the cleaning liquid across the full width of the suction chamber and being extracted therefrom by virtue of the air-flow entering the carpet from beneath the lower edges of the walls of the suction chamber 11 and through the carpet backing to provide a uniform and thorough cleaning action without overwetting even when the cleaning head is held stationary for spot cleaning and stain removal.

The provision of the apertures 28 serves to prime the liquid reception chamber 25 with cleaning liquid without the need to rely on any other means for delivering the liquid, such as by gravity, air pressure or mechanical pump although such other means may be provided if desired to assist the delivery of liquid. In addition, when not in use ther is substantially no net flow of cleaning liquid to the liquid delivery chamber 29 of the inner compartment 20 and from thence to the floor surface as previously described.

In order to prevent wastage of the cleaning liquid, the liquid reception chamber 25 may be provided with an elongate valving and distribution float bar 27 which is disposed within the liquid reception chamber 25 and preferably extends over substantially the full length and width thereof whilst being slidable therein between the uppermost surface of the T-section bar member 30 and the upper wall of the chamber 25, the float bar 27 being buoyant in the cleaning liquid. The inner ends of the apertures 28 preferably open into respective raised lips **28*a* which are engageable with the float bar to close the apertures when the float bar is lifted into contact therewith. It will be understood that once the apertures 28 are closed there is no longer any tendency for liquid to be positively drawn into the chamber 25. In order to prevent passive syphoning of liquid into the chamber, the float bar may also be arranged to engage around the end of the inlet spigot 21** to close it.

The float bar 27 when provided also serves to distribute the cleaning liquid from the inlet 21 across the entire area of the liquid reception chamber 25 since the cleaning liquid on entering the chamber 25 initially flows over the float bar and when sufficient liquid has entered the chamber 25 the float bar 27 will then float so that it at all times assists in the distribution of the liquid.

The second embodiment as shown in FIGS. 10 to 14 is of a generally similar form to that of the first embodiment and like reference numerals are used in these figures to denote corresponding parts, and the following description will be confined to features of difference from the first embodiment.

In the second embodiment the open mouth 23 of the inner compartment 20 is arranged substantially parallel to the open mouth 13 of the suction chamber 11 but is spaced somewhat inwardly therefrom. In addition, the lower edges of the side walls 22 of the inner compartment 20 are formed with a plurality of equi-distant grooves **22*b*. The effect of the grooves 22*b*** is to cause mechanical agitation of the carpet fibres as they pass between the grooves due to the reduced compression of the carpet fibres in the location of the grooves. Such reduced compression serves to assist in the wetting of the carpet fibres which, with the mechanical agitation, enhances the cleaning process.

As a result of the inward spacing of the open mouth of the inner compartment 20 in this embodiment, when the head is applied to carpet, that part of the carpet which is surrounded by the open mouth of the suction head is caused to be lifted such that it becomes engaged with the inner compartment 20 and as a result air is caused to flow into the suction chamber 11 through the carpet in the region abutting lower edges of the side walls **12*a*, 12*b* of the suction chamber 11 and also from underneath the carpet through the backing and fibres. This upward cleaning action serves to assist in preventing overwetting of the carpet backing and underlay which could otherwise result in permanent damage to the carpet. The upward flow further combines with the cleaning liquid being drawn downwards into the carpet from the inner compartment 20 to create a turbulence in the form of bubbles of air which expand rapidly as they rise through the carpet fibres due to the decrease of pressure on entry to the suction chamber 11. This agitation assists the detergent action of the cleaning liquid in penetrating and releasing soil from the carpet fibres. The action is further combined with the mechanical agitation of the fibres by the groove 22*b* in the outer edges of the inner comparment 20** which act on the fibres as the cleaning head is moved in both forward and reverse directions.

It will be appreciated that the scope of the present invention need not be limited to the particular embodiments described above. In particular, whilst the inner compartment is most conveniently formed as a structurally separate unit which is inserted into the suction head, it will be understood that it may be integrally formed within the suction head.

Whilst the calibrated air-flow passageway in the illustrated embodiments comprises a pair of small apertures 28 which extend through the upper wall of the inner compartment and open into the upper region of the suction chamber 11, other arrangements are possible. For example, there may be a single opening in the upper region of the side wall 22 of the inner compartment 20 in register with the opening afforded by the outlet 14, or a tube may extend from the inner compartment into and along the length of the outlet 14.

One particular advantage of the embodiments of head as illustrated, which includes the apertures 28 so as to obviate the need for a pressurised liquid delivery system, is that such heads can be used with conventional wet pick-up cleaners in order to convert such cleaners to carry out a cleaning process in which the cleaning liquid is applied to the surface to be cleaned through the cleaning head and simultaneously extracted in a single operation. It will be understood that for this purpose it is merely necessary to replace the conventional cleaning head of such wet pick-up cleaners with the head in accordance with the invention and to connect the inlet 21 to a source of cleaning liquid, which may be contained in a bucket or other suitable container.

What is claimed is:

1. A suction cleaning head, comprising:

a body defining a suction chamber having a boundary wall defining an open mouth and having an outlet adapted to be connected to an air extraction means, and an inner compartment extending across the suction chamber and having a substantially planar open mouth substantially in the plane of the open mouth of the suction chamber, wherein said inner compartment is divided by a separating wall into an outer liquid delivery chamber adjacent to said open mouth of the inner compartment and an internal liquid reception chamber which extends across the suction chamber and which has an inlet adapted to be connected to a supply of cleaning liquid, and a plurality of liquid flow passageways extending through said separating wall between the liquid reception chamber and the liquid delivery chamber, and wherein an air-flow passageway extends from the interior of the liquid reception chamber to a position within a low pressure zone downstream of the open mouth of the suction chamber.

2. The cleaning head according to claim 1, wherein said air-flow passageway comprises a plurality of openings located in an upper region of the liquid reception chamber.

3. The cleaning head according to claim 2, wherein said plurality of openings are formed in an upper wall of said inner compartment.

4. The cleaning head according to claim 1, wherein valving means are provided in the liquid reception chamber to restrict further flow of cleaning liquid through the liquid reception chamber when the liquid reception chamber is full of cleaning liquid.

5. The cleaning head according to claim 4, wherein said valving means comprises a float bar which is vertically movable within said liquid reception chamber.

6. The cleaning head according to claim 1, wherein said liquid reception chamber is so dimensioned to serve as a storage reservoir within the cleaning head for the cleaning liquid, which reservoir has a height sufficient to create a substantially equal hydrostatic head pressure at each of the liquid flow passageways.

7. The cleaning head according to claim 1, wherein said liquid reception chamber has sufficient volume such that when full a substantially equal flow rate of cleaning liquid from each of the liquid flow passageways can be achieved during application of the open mouth to a surface.

8. The cleaning head according to claim 1, wherein the edges of the inner compartment at the open mouth thereof are provided with a plurality of grooves.

9. A cleaning head according to claim 1, wherein the mouth of said inner compartment is inwardly spaced from the mouth of said suction chamber.

10. The cleaning head according to claim 1, wherein said inner compartment is a separate unit which is removable from the suction chamber.

11. A separable inner housing for a suction cleaning head, comprising:

an elongate body affording an elongate open mouth, the housing being divided by a separating wall into an outer liquid delivery chamber adjacent to said open mouth and an inner liquid distributing chamber having a liquid inlet, said separating wall being formed with a plurality of fine outlet passageways at closely spaced intervals along the length thereof to allow liquid to flow from said liquid distributing chamber into said liquid delivery chamber at a position spaced from the open mouth, wherein an air-flow passageway is provided in a region of the liquid distributing chamber which is spaced above said dividing wall, said air-flow passageway extending from the interior of the liquid distributing chamber to the exterior of the body.

* * * * *